US006939141B2

(12) United States Patent
Ma

(10) Patent No.: US 6,939,141 B2
(45) Date of Patent: Sep. 6, 2005

(54) ADVANCED PATCH PANEL

(75) Inventor: Tsu-Yuan Ma, Taipei (TW)

(73) Assignee: Hsing Chau Industrial Co., Ltd., Taipei (TW)

( * ) Notice: Subject to any disclaimer, the term of this patent is extended or adjusted under 35 U.S.C. 154(b) by 10 days.

(21) Appl. No.: 10/670,705

(22) Filed: Sep. 23, 2003

(65) Prior Publication Data

US 2005/0064760 A1 Mar. 24, 2005

(51) Int. Cl.[7] ..... H01R 9/24

(52) U.S. Cl. ..... 439/49; 439/718; 439/719; 439/941; 248/73

(58) Field of Search ..... 439/718, 941, 439/49, 719; 248/68.1, 73; 385/135; 361/826, 829; 211/26

(56) References Cited

U.S. PATENT DOCUMENTS 3,154,281 A * 10/1964 Frank ..... 248/201
3,991,960 A * 11/1976 Tanaka ..... 248/68.1
4,782,427 A * 11/1988 Marks ..... 361/824
5,145,380 A * 9/1992 Holcomb et al. ..... 439/49
6,771,872 B2 * 8/2004 Wu et al. ..... 385/137

* cited by examiner

*Primary Examiner*—Neil Abrams
(74) *Attorney, Agent, or Firm*—Birch, Stewart, Kolasch & Birch, LLP

(57) ABSTRACT

A patch panel mainly includes a panel with support holes which may be of rectangular shape and is located on each side of the panel; an electric circuit board mounted on the panel, which is structured a plurality of jacks and a plurality of IDC sets (Insulation Displaced Contact); the plurality of jacks separated into at least one set, which are parallelly located on the electric circuit board; the plurality of IDC sets separated into upper and lower sets, which are parallelly located on the electric circuit board and electrically connect with the plurality of jacks; a plurality of cable split rings with flexible holders to be plugged into the support holes oriented horizontally or vertically; and a cover with a plurality of openings, which covers the electric circuit board and exposes the jacks and the IDC sets.

5 Claims, 4 Drawing Sheets

ADVANCED PATCH PANEL

FIELD OF THE INVENTION

The present invention relates to a patch panel, and more particularly to a patch panel having a wires-easy arranged and low-cross-talk patch panel thereon.

BACKGROUND OF THE INVENTION

Following a trend of net communities and net office buildings, a machine room's setup is not as simple as before. Extranet cables of the machine room, such as 256Kbytes, 512Kbytes, T1 or T3, can be provided by ISP (Internet Service Provider), and then be separated as intranet cables to each home of the communities and to each company of the office building, and then finally separated to each room of the home and each seat of the office. Due to the home moving in the communities and the seat changing in the office, original intranet cables could be moved to new homes and seats, and IP addresses needn't to be reconfing again. Therefore, how to smoothly arrange the original complex network cables and how to avoid cross-talk interference between network cables are the key points of net trend.

By one way ago, just like a patch panel of FIG. 1. Using a cable split ring 62 on a back board 60 to arrange network cables 80. The direction of the cable split ring 62 is parallel to the patch panel. After cutting outer covering layer of the network cable 80, exposing network wires 82 and then putting the network cable 80 from upper to lower into the cable split ring 62, and finally embedding the network wires 82 into IDC set (Insulation Displaced Contact) 74 to let the network wires 82 electrically connect to IDC sets 74. And IDC sets 74 connect to jacks 72 electrically on a electric board (not shown). However, prior cable split rings 62 are fixed parallel to the direction of the patch panel. If network cables are come from the parallel direction of the patch panel, it will be inconvenient to arrange the network cables. Besides, the IDC sets 74 of prior patch panel is having eight ports in one line. After cutting the outer covering layer of the network cable 80, four sets of double twisted network wires must be separated and embedded into each port of IDC set 74 according to each network wire's color. Therefore, the double twisted network wires designed to prevent EMI are separated into two parallel wires with different lengths which result high cross-talk and lower telecommunication quality.

SUMMARY OF THE INVENTION

A primary object of the present invention is to provide a cable split ring which can be plugged horizontally and vertically into a patch panel to arrange network cables coming from horizontal and vertical direction and prevent the network cables from complicating twisted.

Another object of the present invention is to provide a double-lines IDC set which can reduce length differences of network wires to lower the effect of cross talk and improve communication quality.

To achieve the above objects, the wires-easy-arranged and low-cross-talk patch panel of the present invention mainly includes a panel with support holes which may be of rectangular shape and is located on each side of the panel; an electric circuit board mounted on the panel, which is structured a plurality of jacks and a plurality of IDC sets (Insulation Displaced Contact); the plurality of jacks separated into at least one set, which parallelly located on the electric circuit board; the plurality of IDC sets separated into one upper and one lower sets, which are parallelly located on the electric circuit board and electrically connected with the plurality of jacks; a plurality of cable split rings with flexible holders to be plugged into the support holes oriented horizontally or vertically; and a cover with a plurality of windows ,which covers the electric circuit board and exposes the jacks and the IDC sets. After placing network cables into the cable split rings, then cutting the outer covering layer of the network cable to separate four sets of double twisted network wires and embed into upper and lower sets of IDC set according to each network wire's color. Therefore, the length differences of network wires embedded into IDC sets are not too large to result high cross-talk and effect telecommunication quality.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
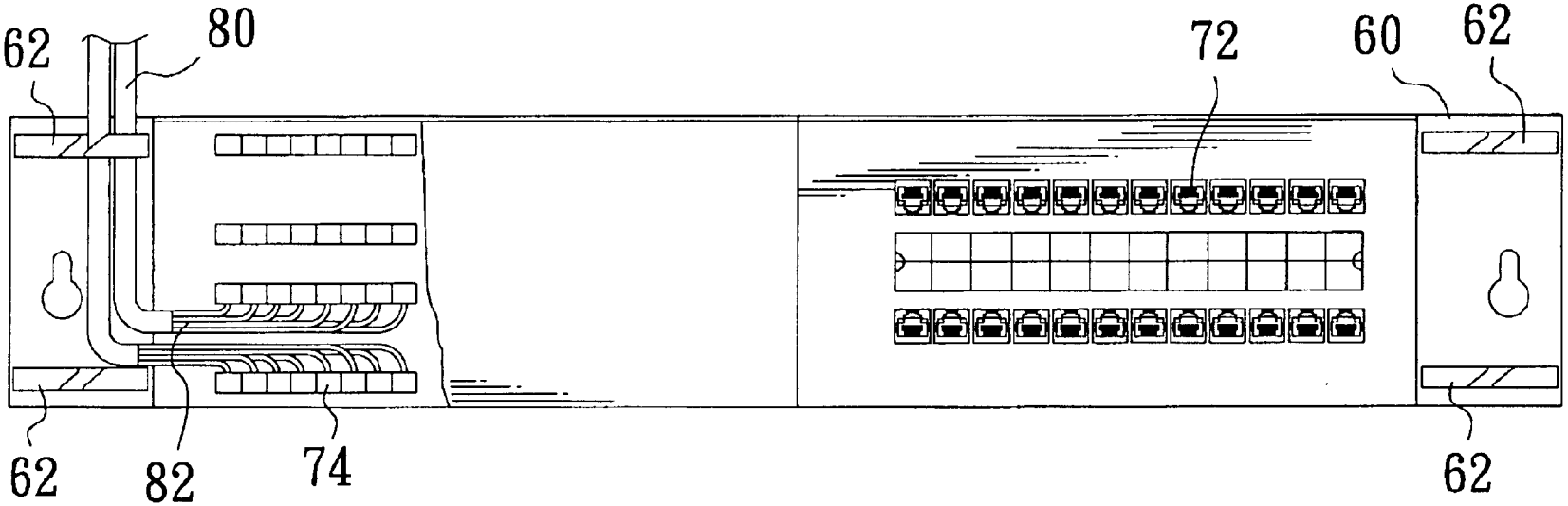
(PRIOR ART) Fig. 1
FIG. 1 is a perspective view of a patch panel according to the prior invention.
Figure 2:
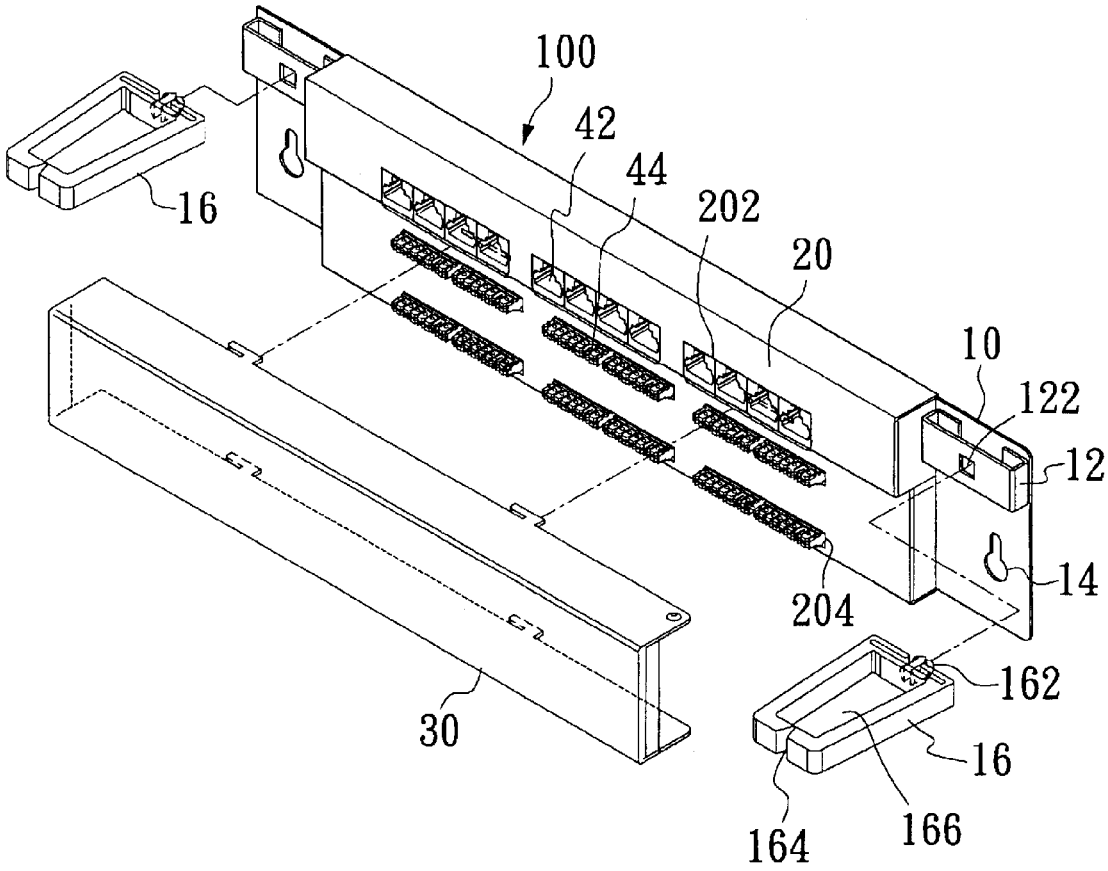
FIG. 2 is an exploded perspective view of a patch panel according to the present invention.

Referring to FIG. 2 illustrated the exploded perspective view of the present invention, a patch panel 100 has a back board 10 which has a fixed frame 12 and a hanging hole 14 on each side. The fixed frame 12 has a support hole 122, and the support hole 122 is a rectangular hole which can be embedded into a flexible holder 162 of a cable split ring 16. Through the hanging hole 14, the patch panel 100 can be fixed on a wall and an office's partition. The cable split ring 16 has a flexible holder 162 embedding into a support hole 122 vertically or horizontally, and then network cables are placed into a cable placer 166. The back board 10 is set a electric board (not shown) which is structured one line of jacks 42 and two lines of IDC set 44. The jacks 42 connect with IDC sets 44 by electrical circuits on the electric board. The jacks 42 can be plugged by RJ-45. The network wires 52 in the network cables 50 can be embedded in the IDC set 44 separately and insulatively to let the network wires electrically connect with the IDC set 44. Because the IDC sets 44 connect the jacks 41 by electrical circuits, extra network cables could connect with intra network cables through IDC set 44 and jacks 42. A cover board 20 has jack windows 202 and IDC set windows 204. The cover board 20 covers the electrical board to make it pretty and keep from harmed, jacks 42 and IDC set 44 respectively expose the jack windows 202 and the IDC set windows 204. Besides, there is a protective cover 30 covering IDC set windows 204 to protect network wires, and jacks 42 are uncovered to make intranet jack easy to be plugged into the patch panel 100.

Figure 3:
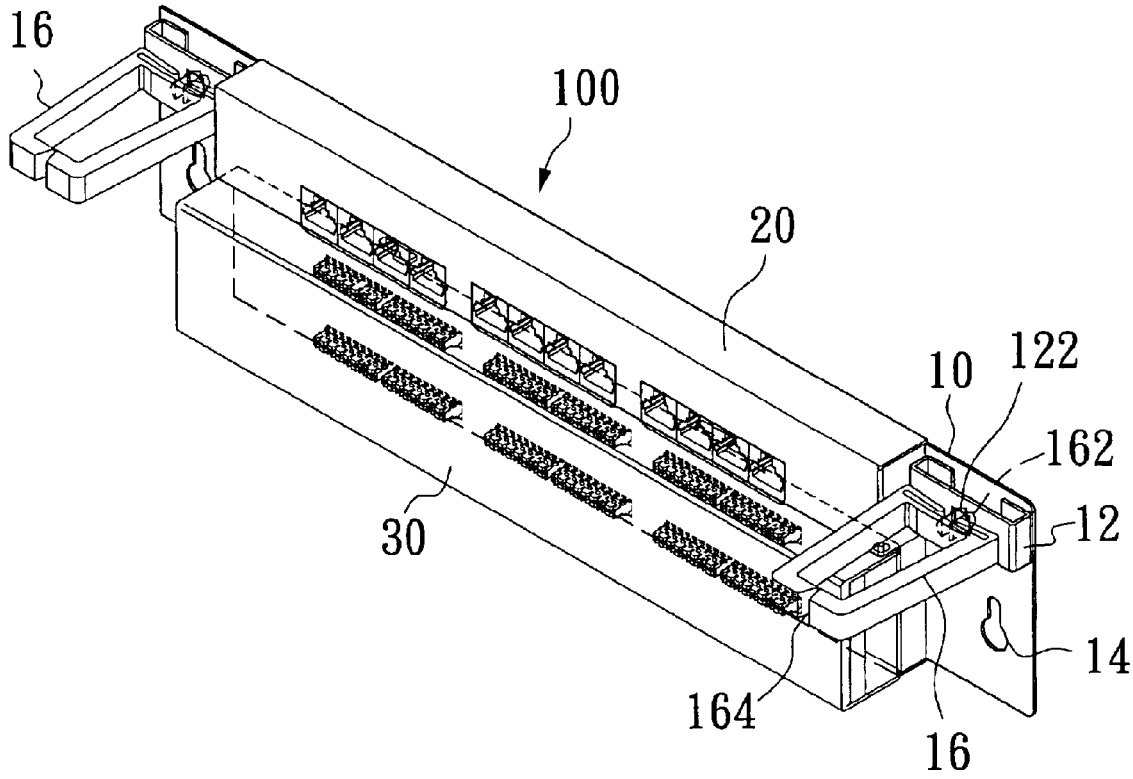
FIG. 3 is a perspective view of cable split rings placed on the present invention.

Referring to FIG. 3 illustrated the cable split rings placed on the present invention, the flexible holders 162 of the cable split rings plug into the support holes 122 of the fixed frame 12 of the two sides of the back board 10. A cover-board 20 covers the electrical board on the back board 10, and the jacks 42 and IDC-sets 44 are exposed, and then a protective-cover 30 covers IDC-sets 44.

Figure 4:
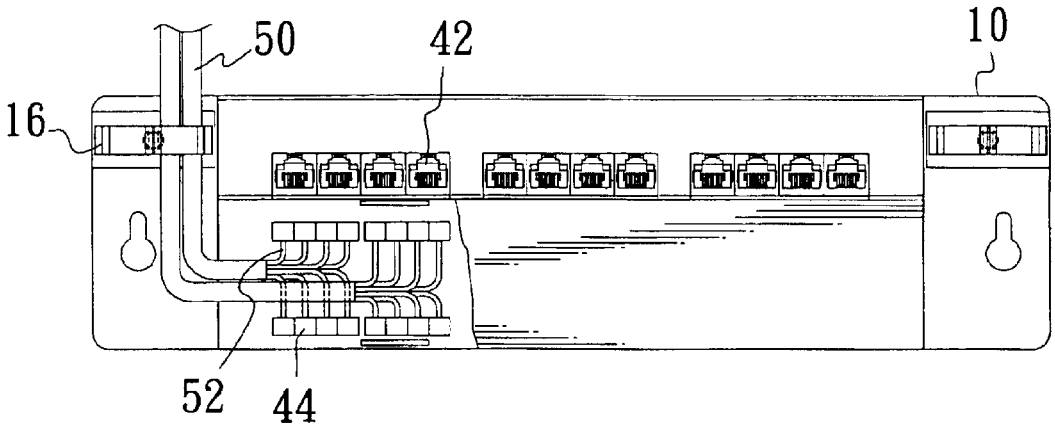
FIG. 4 is a front view of a first embodiment of the present invention.

Referring to FIG. 4 illustrated the front view of a first embodiment of the present invention, four sets of double twisted network wires (not shown) in each network cable 50 are separated into eight network wires 52, and each network wire 52 is embedded into IDC sets 44 respectively according to colors, and each IDC sets 44 is divided into one upper line and one lower line, and each line has four ports. The eight network wires 52 are plugged into the upper line and the lower line of IDC sets 44 respectively according to colors. Therefore, in one line, the length differences of the network wire plugged in the first left port and the one plugged in the first right port is not too large to result cross-talk.

Figure 5:
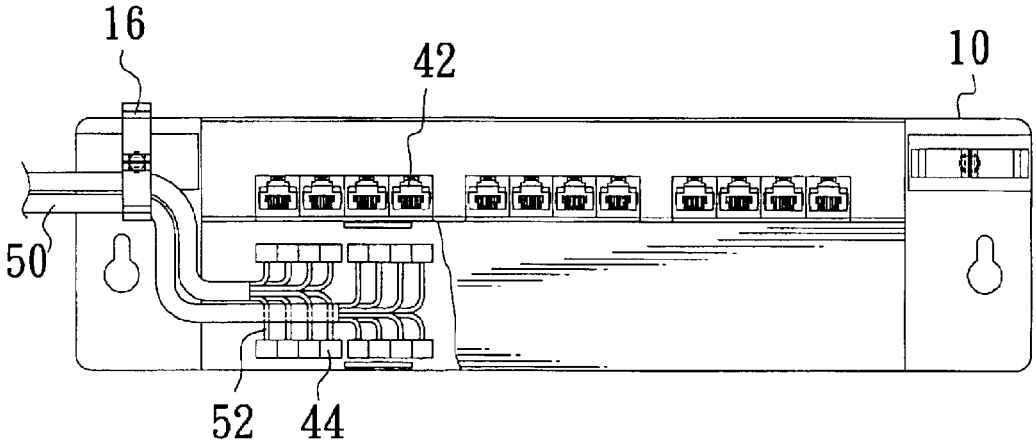
FIG. 5 is a front view of a second embodiment of the present invention.

Referring to FIG. 5 illustrated a front view of the second embodiment of the present invention, which describes how the cable split ring 16 positioned vertically on the patch panel 100 arranges the network cables parallel to the patch panel 100. The network cable 50 are placed to the cable placer 166 from the side of the back board 10, and then the outer covering layer of the network cable 50 are cut. Then four sets of double twisted network wires 52 are embedded into the four ports of the upper line and those of the lower line of IDC sets 44 according to each network wire's color, and each jack 42 is responsed to a IDC set 44. Therefore, the network wires 52 in the external network cables 50 are plugged into the upper and the lower lines of IDC sets 44, and IDC sets 44 connect with jacks through electrical circuits on the electrical board, and then the external network cable 50 can connect with the internal network wires, such as RJ-45.

According to the present invention, each IDC set is divided into one upper and one lower lines with four ports to reduce the length difference of the network wires plugged in the first left port and the first right port to overcome the cross-talk. Furthermore, The cable split rings of the present invention can be rotated 90 degrees to conveniently arrange the network cables from vertical or parallel direction of the patch panel. The IDC sets can be divided into two or four lines, the position of the jacks can be above or below the IDC sets, or divided into two lines above and below the IDC sets according to actual electrical circuit board design.

A advanced Patch Panel is described above. Various details of the invention may be changed without departing from its scope. Furthermore, the foregoing description of the preferred embodiments of the invention and the best mode for practicing the invention are provided for the purpose of illustration only and not for the purpose of limitation-the invention being defined by the claims.

What is claimed is:

1. A patch panel for arranging at least one network cable divided into a plurality of network wires, comprising:

a back board having a first support hole on the right side and a second support hole one on the left side, each of said first and second support holes is a rectangular hole;

a plurality of jacks;

a plurality of insulation displaced contact sets, each of said plurality of insulation displaced contact sets being divided into an upper contact and a lower contact, a combination of said upper contact and said lower contact receiving a single one of the at least one network cables, said plurality of insulation displaced contact sets being electrically connected to said plurality of jacks;

first cable split ring and a second cable split ring, said first and second cable split rings having a flexible holder plugged into said first and second support holes respectively, said first and second cable split rings being located on said back board vertically or horizontally; and a cover covering the electric board and having a plurality of windows to expose a plurality of said jacks and a plurality of said insulation displaced contact sets.

2. The patch panel as claimed in claim 1, and including a protective cover to cover a plurality of said insulation displaced contact sets to protect a plurality of network wires.

3. The patch panel as claimed in claim 1, wherein said plurality of insulation displaced contact sets are embedded by the network wires.

4. The patch panel as claimed in claim 1, wherein said plurality of network wires are a plurality of double twisted network wires, said plurality of double twisted network wires being received by one of said plurality of insulation displaced contact sets, each of said plurality of double twisted network wires including a first wire and a second wire, said first wire being received by said upper contact and said second wire being received by said lower contact.

5. The patch panel as claimed in claim 4, wherein said upper contact includes a plurality of upper ports and said lower contact includes a plurality ports, said first wire being received by one of said plurality of upper ports, said second wire being received by one of said plurality of lower ports, said one of said plurality of upper ports and said one of said plurality of lower ports being aligned vertically.

* * * * *